US005799499A

United States Patent [19]

Yano et al.

[11] Patent Number: 5,799,499

[45] Date of Patent: Sep. 1, 1998

[54] COMBINED UNIT OF EXPANSION VALVE AND RESERVOIR TANK

[75] Inventors: Masamichi Yano; Takuji Furuta, both of Tokyo, Japan

[73] Assignee: Fujikoki Corporation, Tokyo, Japan

[21] Appl. No.: 651,538

[22] Filed: May 22, 1996

[30] Foreign Application Priority Data

Sep. 27, 1995 [JP] Japan ..... 7-249278

[51] Int. Cl.[6] ..... F25B 41/04

[52] U.S. Cl. ..... 62/225; 62/509; 62/513

[58] Field of Search ..... 62/509, 513, 217, 62/225

[56] References Cited

U.S. PATENT DOCUMENTS

| | | | |
|---|---|---|---|
| 3,525,234 | 8/1970 | Widdowson | 62/509 |
| 3,938,349 | 2/1976 | Ueno | 62/225 X |
| 4,364,238 | 12/1982 | Huelle et al. | 62/217 |
| 4,756,166 | 7/1988 | Tomasov | 62/217 X |
| 5,415,014 | 5/1995 | Waldschmidt et al. | 62/509 |
| 5,454,233 | 10/1995 | Naujock | 62/509 |

*Primary Examiner*—Henry A. Bennett
*Assistant Examiner*—Susanne C. Tinker
*Attorney, Agent, or Firm*—Foley & Lardner

[57] ABSTRACT

A unit incorporating a reservoir tank and an expansion valve into a single built-in structure comprises a reservoir tank 10 sealed by a cover 20, and an expansion valve 30 fixed on the cover 20. A refrigerant pipe 40 extending through the cover 20 introduces a refrigerant from a compressor through a condenser into the reservoir tank 10. The refrigerant introduced into the expansion valve 30 through a pipe 50 increases in volume, and then enters an evaporator. After passing the evaporator, the refrigerant in the gaseous phase flows through pipe 62 into the expansion valve 30, then delivers thermal information of the refrigerant to a heat sensitive member of the expansion valve, and travels in a pipe 70 extending into and from the reservoir tank 10. While traveling along the pipe 70, the gaseous refrigerant exchanges heat with the liquid refrigerant stored in the reservoir tank, and then returns to the compressor.

9 Claims, 10 Drawing Sheets

COMBINED UNIT OF EXPANSION VALVE AND RESERVOIR TANK

BACKGROUND OF THE INVENTION

1. Field of the Invention

This invention relates to a unit incorporating a reservoir tank and an expansion valve into a single built-in structure for use in a refrigerating cycle of an air conditioner.

2. Description of the Prior Art

The refrigerating cycle of a typical conventional air conditioner is made of a refrigerant compressor, condenser, reservoir tank, expansion valve, evaporator, and so on, and pipes connecting these elements.

A hot gaseous refrigerant compressed in the compressor is liquidized in the condenser due to heat exchange with ambient air, and then stored in the reservoir tank. The liquid refrigerant in the reservoir tank is introduced into the expansion valve and decompressed there. The low-pressure refrigerant is sent to the evaporator located in the cabin of a car to cool the interior air by heat exchange with it.

More specifically, as shown in FIG. 12 which illustrates a refrigerating cycle of a car air conditioner, a gaseous, hot, compressed refrigerant from the compressor 30 is cooled and liquidized in the condenser 31 by heat exchange with ambient air. The compressed liquid refrigerant from the condenser 31 is stored in the reservoir tank 10, and eventually introduced into the expansion valve 1. The high-pressure liquid refrigerant is decompressed by the expansion valve 1, then passes through the evaporator 33 while exchanging heat with the intake air. Due to the heat exchange, the refrigerant is vaporized into a low-pressure gas, and returns to the compressor 30 through the expansion valve 1. The expansion valve 1 comprises a valve housing 15 having a prismatic outer configuration and made of, for example, an aluminum alloy. The valve housing 15 defines a high-pressure refrigerant pathway 2 through which a liquid refrigerant to be decompressed travels, a low-pressure refrigerant pathway 3 through which the gaseous refrigerant flows, and a valve bore 4 in form of a narrow orifice interposed in the high-pressure refrigerant pathway 2. The liquid refrigerant flows from the reservoir 10 through an inlet port 21 of the high-pressure refrigerant pathway 2 into a valve chamber 23, decreases in pressure when passing through the throttling valve bore 4, and enters into the evaporator 33 through an outlet port 22 of the high-pressure refrigerant pathway 2.

The upstream end of the valve bore 4 is configured as a valve seat, and a ball-shaped valve member 5 is moved to and away from the valve seat to change the opening rate of the valve bore 4. The valve member 5 is supported on a ball support 7 and is biased toward the valve seat (in the valve opening direction) by a compressive coil spring 9 held between the ball support 7 and an adjusting nut 8.

A valve driving mechanism 20 is mounted on the upper end of the valve housing 15 to sense the temperature of the gaseous refrigerant. The valve driving mechanism 20 comprises a diaphragm 11 for driving the valve member 5 via a valve member operating rod 6, an airtight chamber 12 containing a heat-sensitive gas, and an equalizing chamber 13 divided from the airtight chamber 12 by the diaphragm and communicating with the low-pressure refrigerant pathway 3. The valve-member operating rod 6 is made of an aluminum alloy, and the diaphragm 11 is made of a stainless steel.

An outer wall 14 of the valve driving mechanism 20 has formed an opening 17 which is sealed by a plug 16 made of aluminum, copper or other metal after a heat-sensitive gas, e.g. the same refrigerant as that in the refrigerating cycle, is introduced therethrough into the airtight chamber 12.

Therefore, the airtight chamber 12 containing the heat-sensitive gas changes in pressure in response to thermal changes of the gaseous refrigerant flowing in the low-pressure refrigerant pathway 3. On the other hand, the pressure of the equalizing chamber 13 located under the diaphragm 11 and communicating with the low-pressure refrigerant pathway 3 is equal to the pressure of the gaseous refrigerant flowing in the low-pressure refrigerant pathway 3. Therefore, the diaphragm 11 moves in response to a pressure difference between the airtight chamber 12 and the equalizing chamber 13. This movement is transmitted to the valve member 5 via the valve-member operating rod 6 to control the opening rate of the valve bore 4 and the amount of the refrigerant supplied to the evaporator 33.

In some types of cars, the evaporator, expansion valve, etc. among various devices constituting the refrigerant cycle shown in FIG. 12 are located in the cabin of a car while the compressor and others, i.e. most of the devices of the refrigerating cycle, are located in the engine compartment. In some other types of cars, the expansion valve is mounted in an aperture of a partition wall between the cabin and the engine compartment. Problems with these conventional arrangements are the need for pipes for connecting respective devices or the need for water-proof sealing of an aperture made in a partition wall supporting the expansion valve, which inevitably increases the number of parts or elements and the manhour for assembling or coupling them. Moreover, the refrigerant, which must be liquid when flowing into the expansion valve, is apt to be vaporized before reaching the expansion valve. This invites a decrease in flow amount of the refrigerant and a decrease in refrigerating power of the system.

OBJECTS AND SUMMARY OF THE INVENTION

It is therefore an object of the invention to provide a structure incorporating both a reservoir tank and an expansion valve into a single built-in structure, in which a low-temperature gaseous refrigerant sent from the expansion valve to a compressor is introduced into the reservoir tank for heat exchange with a hot, compressed, liquid refrigerant stored in the reservoir tank to cool it such that the refrigerant reliably maintains the liquid phase when it enters the expansion valve.

According to the invention, there is provided a unit incorporating a reservoir tank and an expansion valve into a single built-in structure. The reservoir tank includes a refrigerant supply pathway through which a gaseous refrigerant sent from the expansion valve to a compressor is introduced into the reservoir tank for heat exchange with a liquid refrigerant stored in the reservoir tank.

DESCRIPTION OF THE PREFERRED EMBODIMENTS

Figure 1:
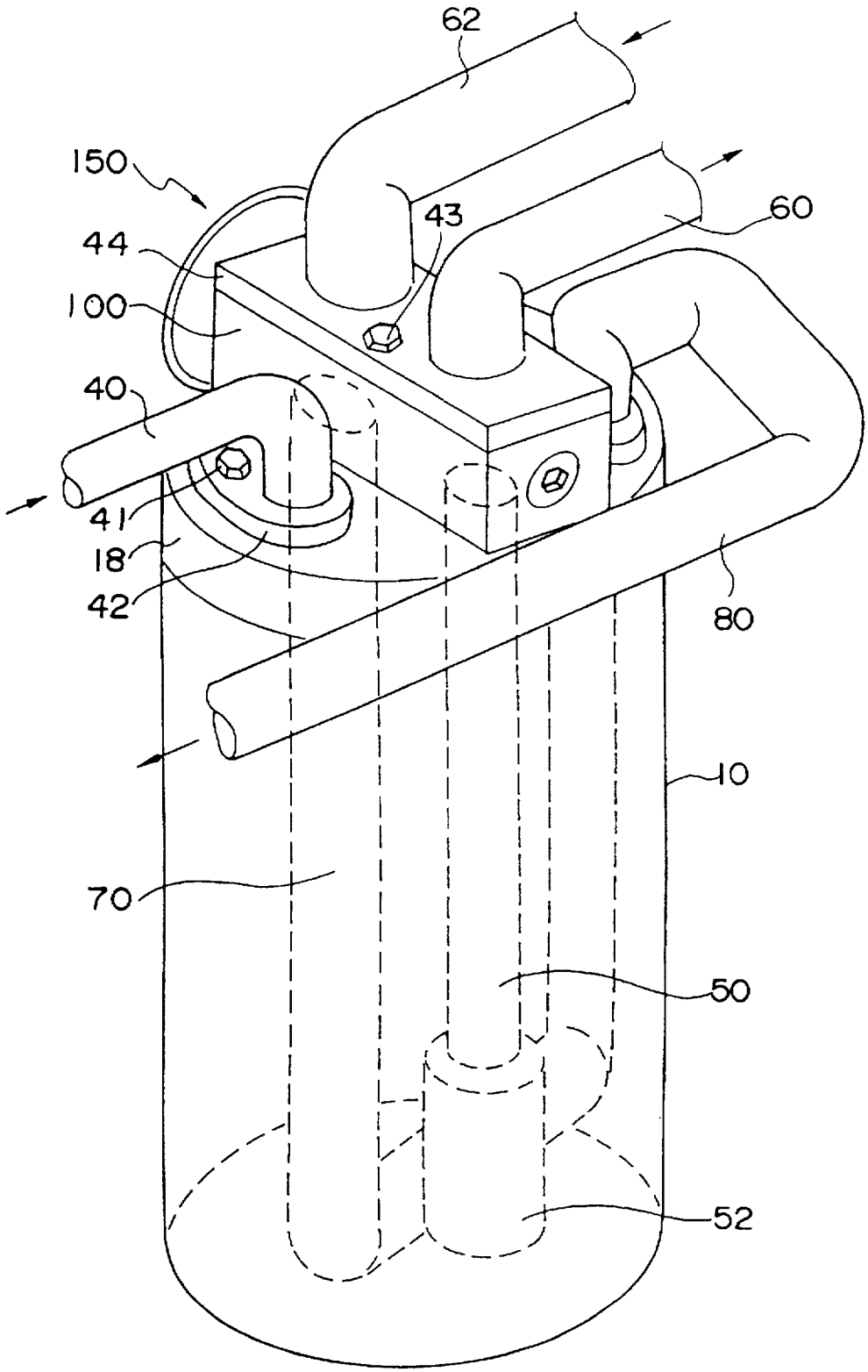
FIG. 1 is a perspective view showing a basic construction of the invention.

FIG. 1 is a perspective view showing a basic construction of the unit according to the invention.

The unit incorporating a reservoir tank and an expansion valve into a single built-in structure comprises a reservoir tank 10 which may be a circular-cylindrical member made of an aluminum alloy. Fixed to the top end of the cylindrical member is a cover 18 by arc welding, for example. Integrally mounted on the cover 18 is an expansion valve 100.

Figure 12:
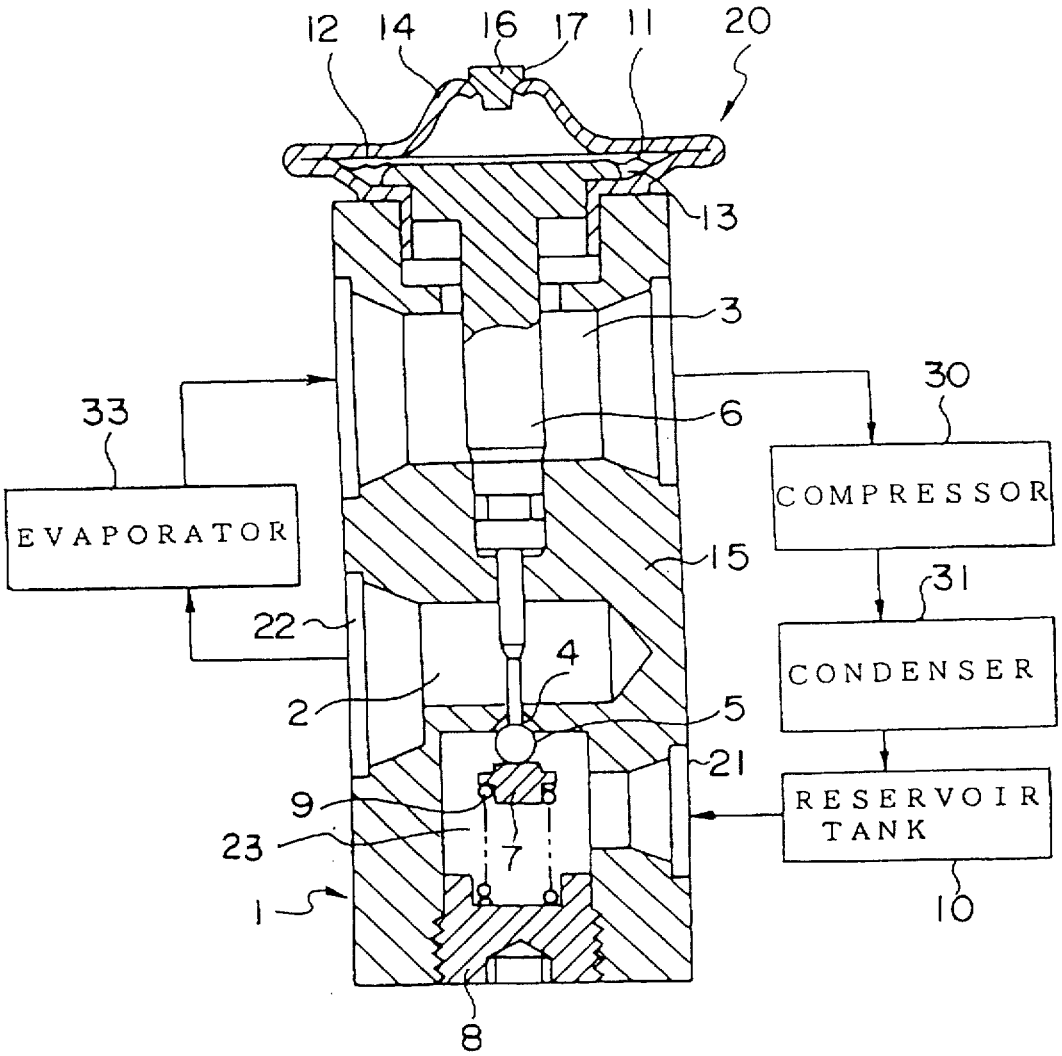
FIG. 12 is a diagram showing a conventional refrigerating cycle.

The expansion valve 100 may have the same construction as the expansion valve 1 of FIG. 12. A hot, compressed, liquid refrigerant is introduced from a condenser (not shown) through a pipe 40 into the reservoir tank 10. The liquid refrigerant is drawn from the bottom of the reservoir tank 10 and delivered to an inlet port of a high-pressure refrigerant pathway of the expansion valve 100 by a suction pipe 50 having a strainer 52 and made of an aluminum alloy. The liquid refrigerant is decompressed and flows from an outlet port of the high-pressure refrigerant pathway in the expansion valve through a pipe 60 into the evaporator (not shown). While passing through the evaporator, the refrigerant exchanges heat with intake air and is vaporized into a low-pressure gas. The gaseous refrigerant flows in a low-pressure refrigerant pathway of the expansion valve 100 through a pipe 62, then transmits the temperature to a heat-sensitive gas in a valve driving mechanism 150, and enters into a pipe 70 made of an aluminum alloy to form a refrigerant supply pathway in the reservoir tank 10.

In FIG. 1, numeral 41 denotes a bolt that fixes a flange 42 to the cover 18 to connect the pipe 40 to the reservoir tank 10, and another bolt 43 fixes a flange 44 to the expansion valve 100 to connect the pipes 60 and 62 thereto.

The gaseous refrigerant in the pipe 70 exchanges heat with the hot, compressed, liquid refrigerant in the reservoir tank 10, and returns to the compressor (not shown) through a pipe 80 fixed to the cover 18. Arrows in the drawing show traveling directions of the refrigerant.

Due to the heat exchange, the liquid refrigerant is in the reservoir tank 10 is supercooled, and the supercooled refrigerant flows into the inlet port of the high-pressure refrigerant pathway in the expansion valve 100.

Figure 2:
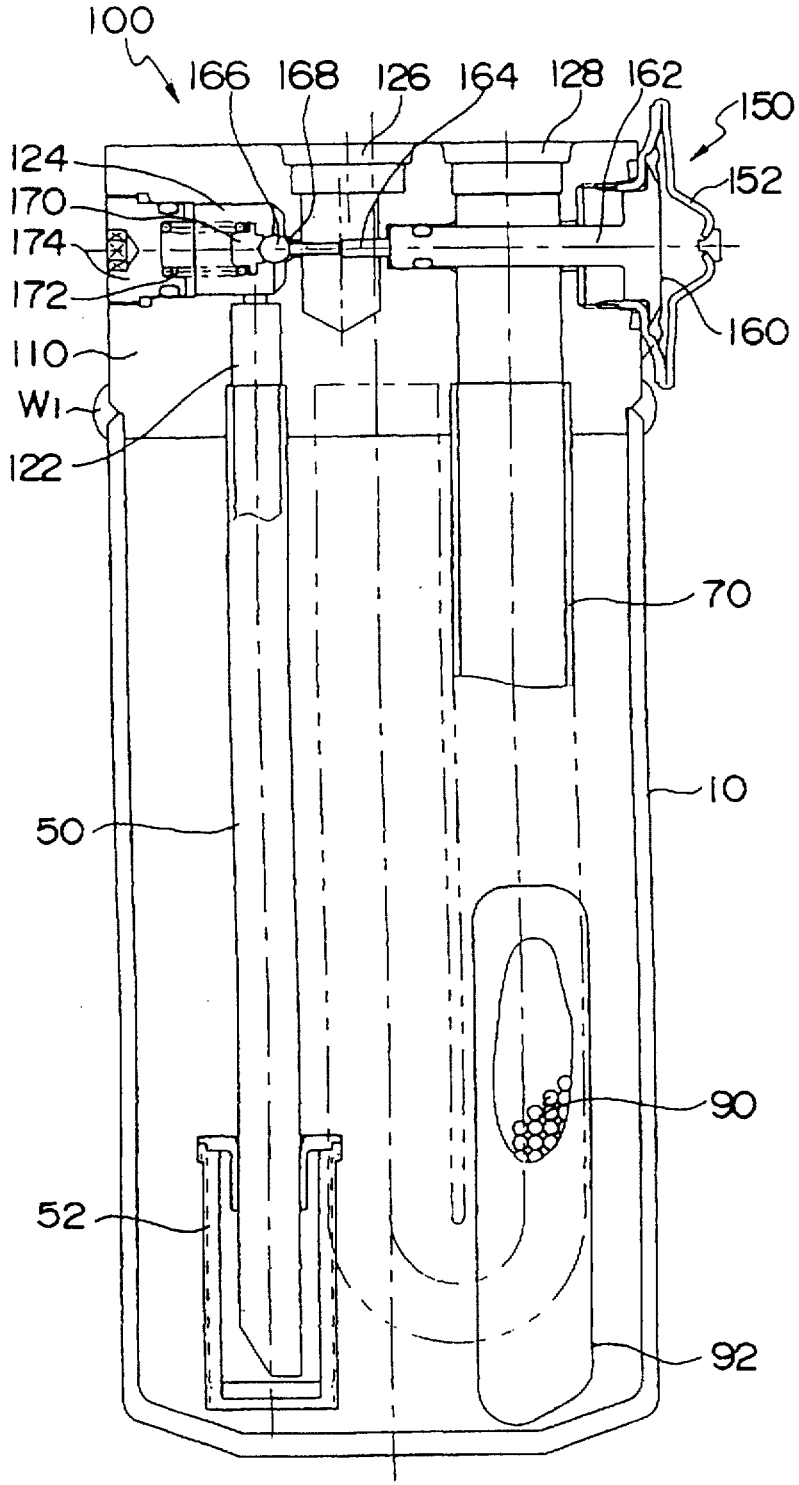
FIG. 2 is a cross-sectional view of an embodiment of the invention.
Figure 3:
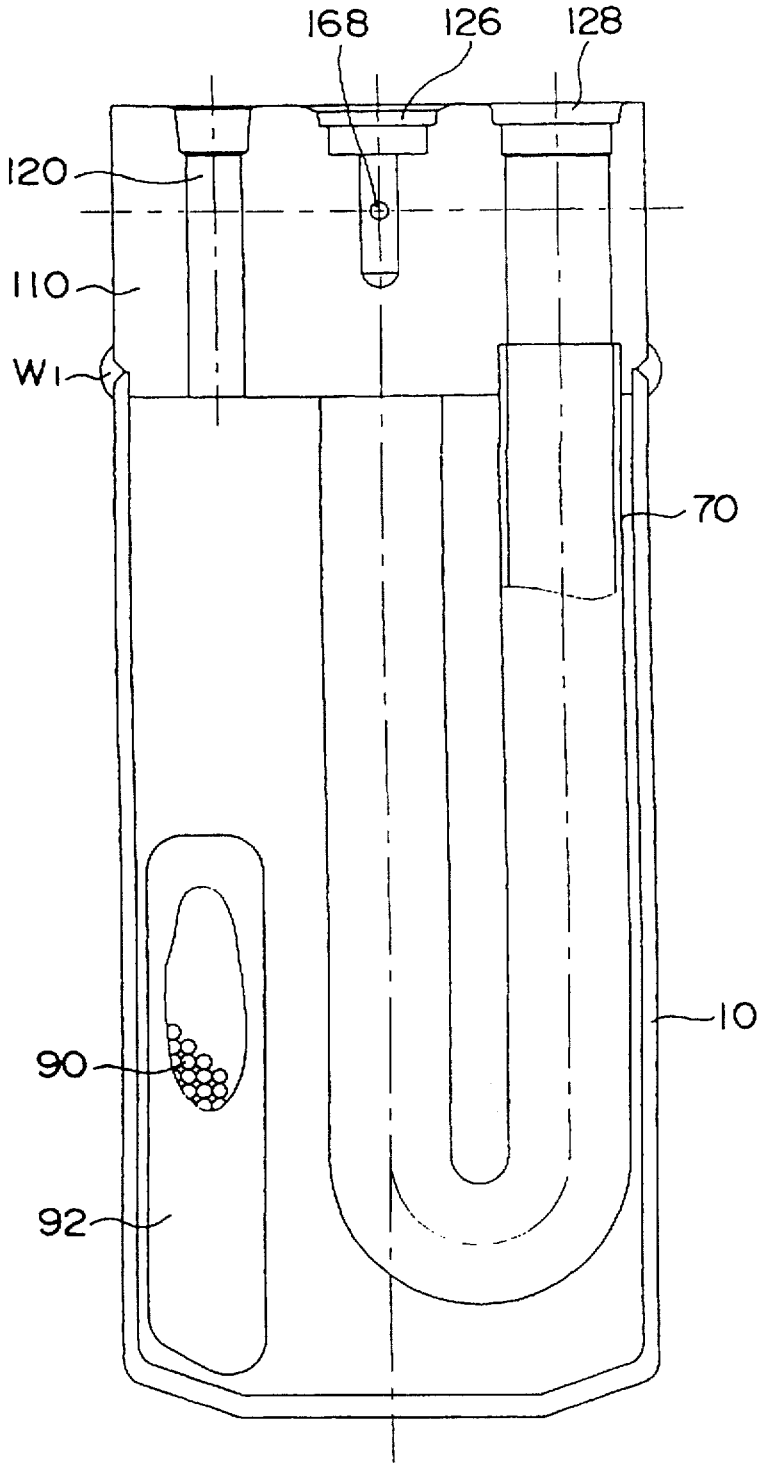
FIG. 3 is another cross-sectional view of the same embodiment of the invention.
Figure 4:
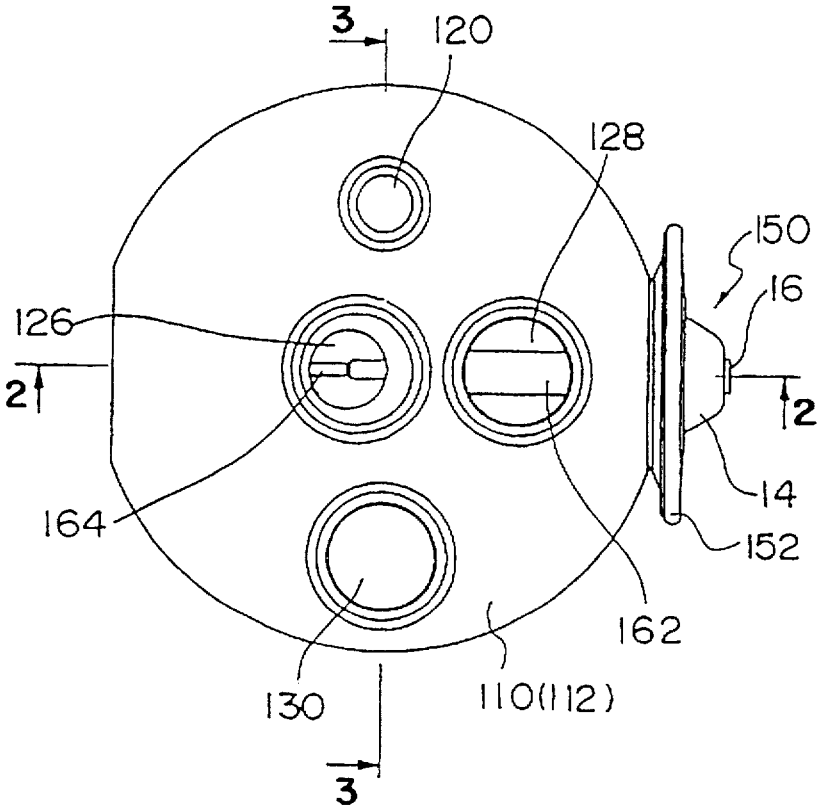
FIG. 4 is a top view of the same embodiment of the invention.

FIG. 2 is a cross-sectional view of a unit of a reservoir tank and an expansion valve, embodying the invention; FIG. 3 is another cross-sectional view of the same unit; and FIG. 4 is a top view of the same unit. FIG. 2 is taken along the A—A line of FIG. 4, and FIG. 3 is taken along the B—B line of FIG. 4. Illustration of the bolt for fixing the flange is omitted from FIG. 4.

In FIG. 2, the expansion valve 100 having the same configuration and operation as those of the expansion valve of FIG. 12 is built in a housing 110. The housing 110 corresponds to the cover 18 of FIG. 1 and forms a main body 112 of the expansion valve 100. The housing 110 is made of an aluminum alloy, for example, and secured to the reservoir tank 10 by arc welding at point W1.

The reservoir tank 10 and its interior pipes are configured as explained with reference to FIG. 1. The reservoir tank 10 further contains a container 92 made of polyester and containing a drying agent 90 for abstracting moisture from the refrigerant in the reservoir tank 10. Otherwise, the drying agent 90 may be located in a strainer used for removing dust from the refrigerant.

The housing 110 has three through holes 120, 128, 130 extending from the upper surface to the lower surface, a blind hole 126 extending from the upper surface for use as an outlet port of a high-pressure refrigerant pathway, and a blind hole 122 extending from the lower surface for use as to form an inlet port of the high-pressure refrigerant pathway. The through hole 128 and the blind holes 122, 126 are aligned on a diametral line, and are connected by a transversal hole. The transversal hole is used to accommodate a valve driving mechanism 150 of the expansion valve 100.

The valve driving mechanism 150 includes a diaphragm 160 held in an airtight chamber 152 to move a valve member operating rod 162 in response to a pressure difference between two chambers separated by the diaphragm 160. The valve member operating rod 162 has a stem 164 at its distal end, and the stem 164 is connected to a valve member 166 to slidably move the valve member 166 in an orifice 168. The valve member 166 is biased in a direction for closing the orifice 168 by the arrangement comprising a valve member support 170, spring 172 and nut 174.

The liquid refrigerant drawn from the reservoir tank 10 via the through hole 120 is introduced into a valve chamber 124 through the pipe 50 and the blind hole 122, then flows through a pathway between the valve body 166 and the orifice 168, where the refrigerant is decompressed. The low-pressure refrigerant is sent to the evaporator (not shown) through the outlet port 126 of the hi-pressure refrigerant pathway. After the refrigerant passes through the evaporator, it flows through the blind hole 128 serving as a low-pressure refrigerant pathway, while transmitting thermal information of the refrigerant to the valve member operating rod 162. Then the rod 162 delivers the thermal information to the gas chamber beyond the diaphragm 160 to control the opening rate of the orifice 168.

After passing the expansion valve 100, the gaseous refrigerant travels along the pipe 70 where the gaseous refrigerant exchanges heat with and cools the liquid refrigerant stored in the reservoir tank 10. After that, the gaseous refrigerant returns to the compressor (not shown) via the through hole 130. The pipes 50 and 70 are connected to the blind hole 122 and the through hole 128, respectively, by brazing or other appropriate means. This aspect of the pipes 50 and 70 also applies to other embodiments which will be described later.

As described, since the unit incorporates the expansion valve 100 and the reservoir tank 10 into a built-in unitary structure, it can reduce the number of parts and elements of the system, and can alleviate the manhour for assembling the system. Moreover, since the gaseous refrigerant exiting from the low-pressure refrigerant pathway of the expansion valve is introduced and used for heat exchange with the liquid refrigerant stored in the reservoir tank, the refrigerant drawn from the reservoir tank into the blind hole 122 still remain sufficiently cool and maintains the liquid phase when it reaches the expansion valve 100. Therefore, a sufficient amount of flow of the refrigerant can be ensured in the expansion valve 100, and a decrease in refrigerating power of the refrigerating cycle can be prevented.

Figure 5:
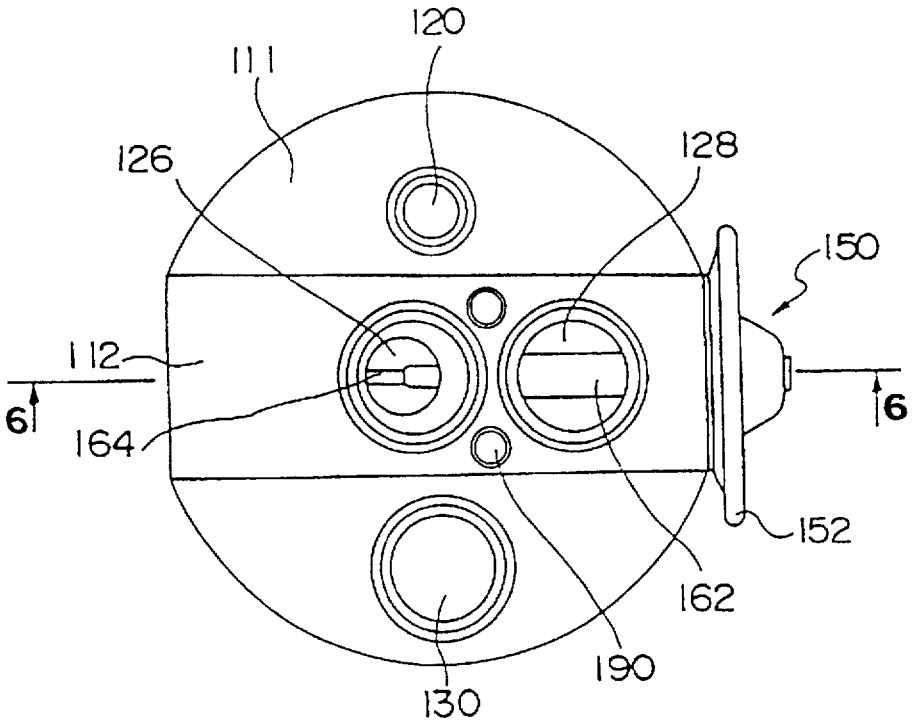
FIG. 5 is a top view of a further embodiment of the invention.
Figure 6:
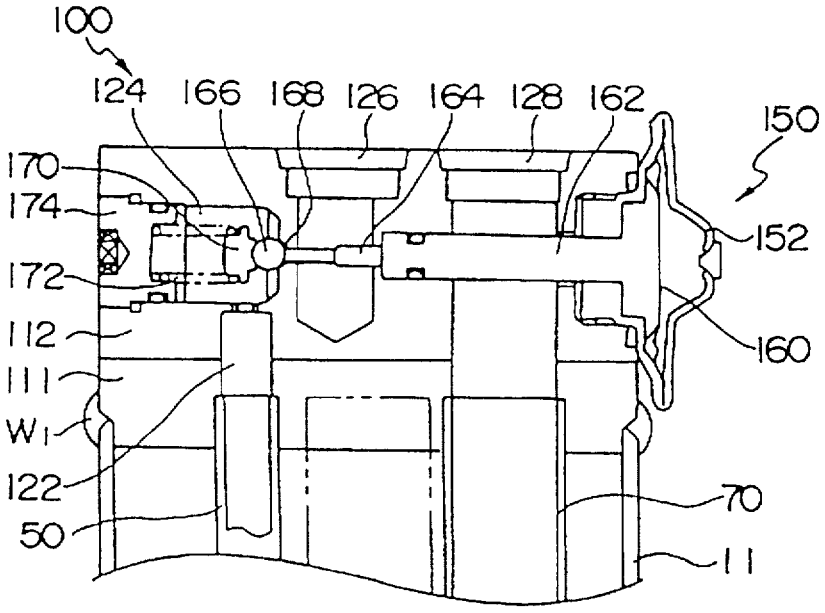
FIG. 6 is a fragmentary cross-sectional view of the further embodiment of the invention.

FIG. 5 is a top view of a further embodiment of the invention, and FIG. 6 is a fragmentary cross-sectional view taken along the X—X line of FIG. 5.

In this embodiment, a cover 111 is secured to the top end of the reservoir tank 10 by welding W1. The cover 111 has a through hole 120 for use as an inlet of the refrigerant sent from a condenser (not shown), and a through hole 130 for use as an outlet of the refrigerant returning to the compressor. Fixed to the top end of the cover 111 is a prismatic or box-shaped main body 112 of the expansion valve 100 by bolts 190. Illustration of flange fixation bolts is omitted from FIG. 5.

The expansion valve 100 has the same configuration and operation as those of the foregoing embodiment. Thus, its parts or elements are labelled with the same reference numerals, and their explanation is omitted here.

Figure 7:
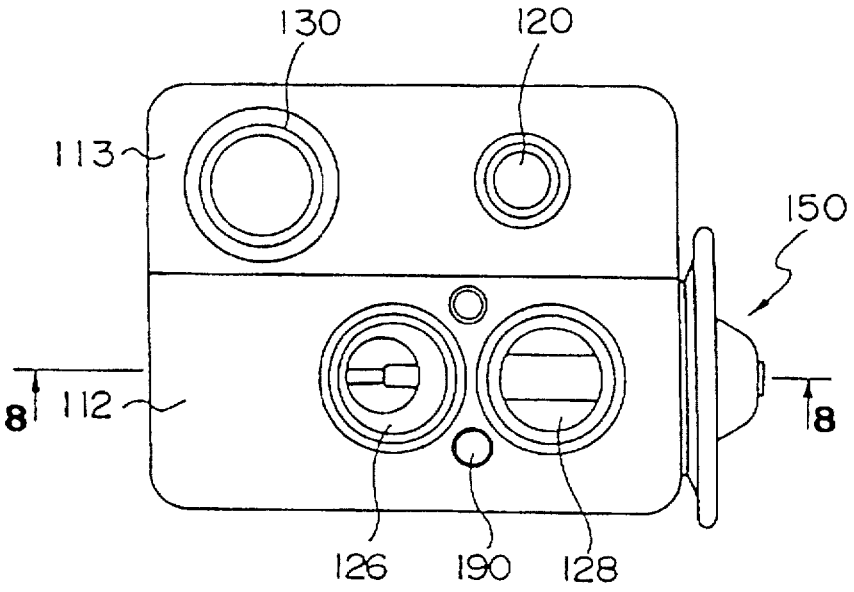
FIG. 7 is a top view of a still further embodiment of the invention.
Figure 8:
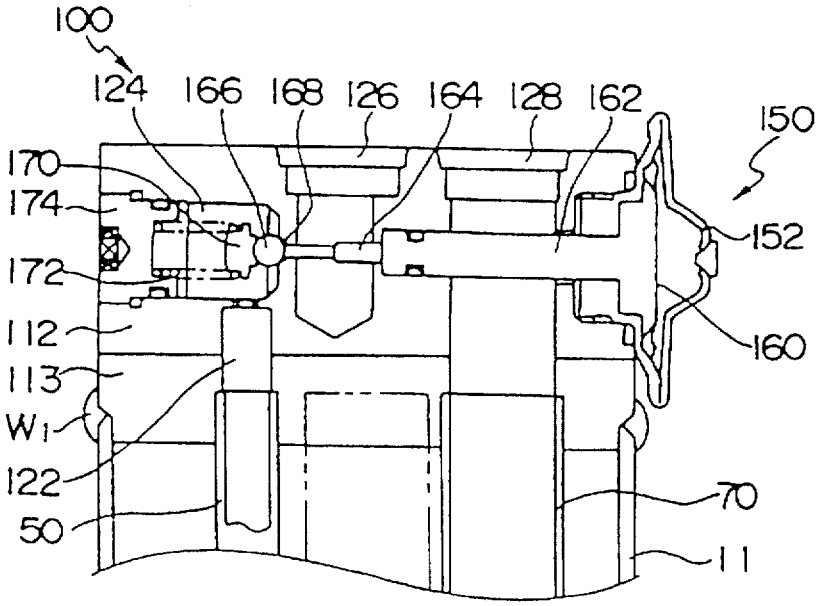
FIG. 8 is a fragmentary cross-sectional view of the still further embodiment of the invention.

FIG. 7 is a top view of a still further embodiment of the invention, and FIG. 8 is a fragmentary cross-sectional view taken along the Y—Y line of FIG. 7.

A reservoir tank 11 used in this embodiment has a polygonal-cylindrical of box-like configuration. Fixed on the top end of the reservoir tank 11 is a cover 113 by welding W1.

The cover 113 has a through hole 120 for use as the inlet for introducing the refrigerant from the condenser, and a through hole 130 for use as the outlet for delivering the refrigerant to the compressor. The prismatic main body 112 of the expansion valve 100 is fixed to the top end of the cover 113 by bolts 190. Illustration of flange fixation bolts is omitted from FIG. 7.

The expansion valve 100 has the same configuration and operation as those of the foregoing embodiments. Thus, its parts or elements are labelled with the same reference numerals, and their explanation is omitted here.

Figure 9:
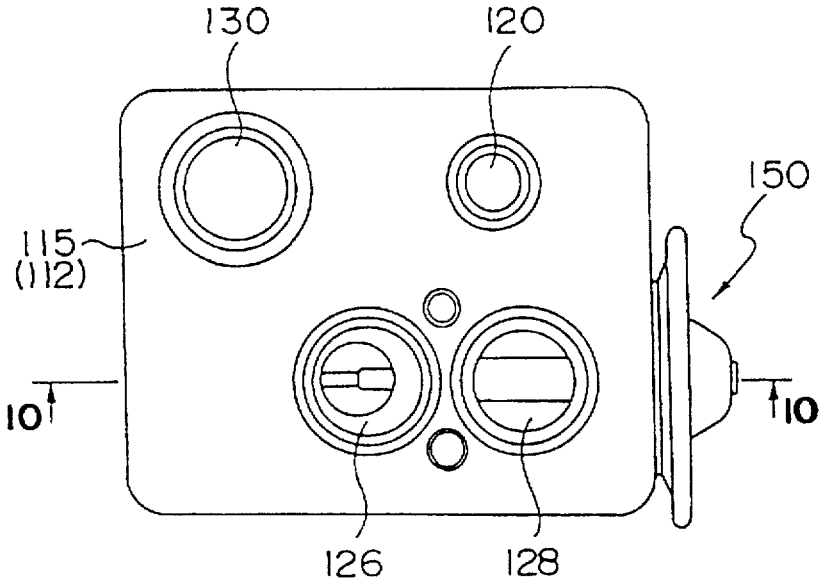
FIG. 9 is a top view of a yet further embodiment of the invention.
Figure 10:
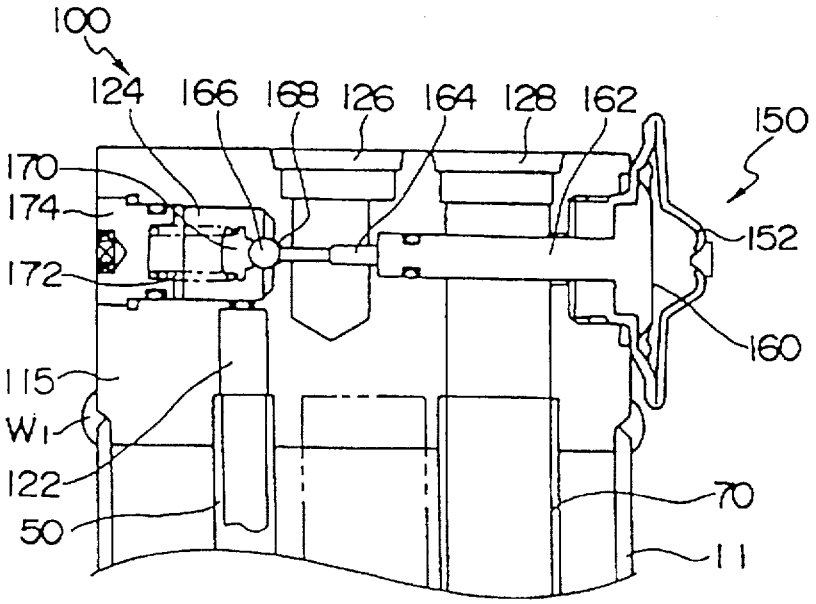
FIG. 10 is a fragmentary cross-sectional view of the yet further embodiment of the invention.

FIG. 9 is a top view of a yet further embodiment of the invention, and FIG. 10 is a cross-sectional view taken along the Z—Z line of FIG. 9.

The reservoir tank 11 used in this embodiment has a polygonal-cylindrical or box-like configuration. Fixed on the top end of the reservoir tank 11 is a housing 115 by welding W1.

The housing 115 has a through hole 120 for use as the inlet for introducing the refrigerant from a condenser, and a through hole 130 for use as the outlet for delivering the refrigerant to the compressor. The housing 115 also serves as the main body 112 of the expansion valve 100. That is, the expansion valve 100 is built in the housing 115. Illustration of flange fixation bolts is omitted from FIG. 9.

The expansion valve 100 has the same configuration and operation as those of the foregoing embodiments. Thus, its parts or elements are labelled with the same reference numerals, and their explanation is omitted here.

Figure 11:
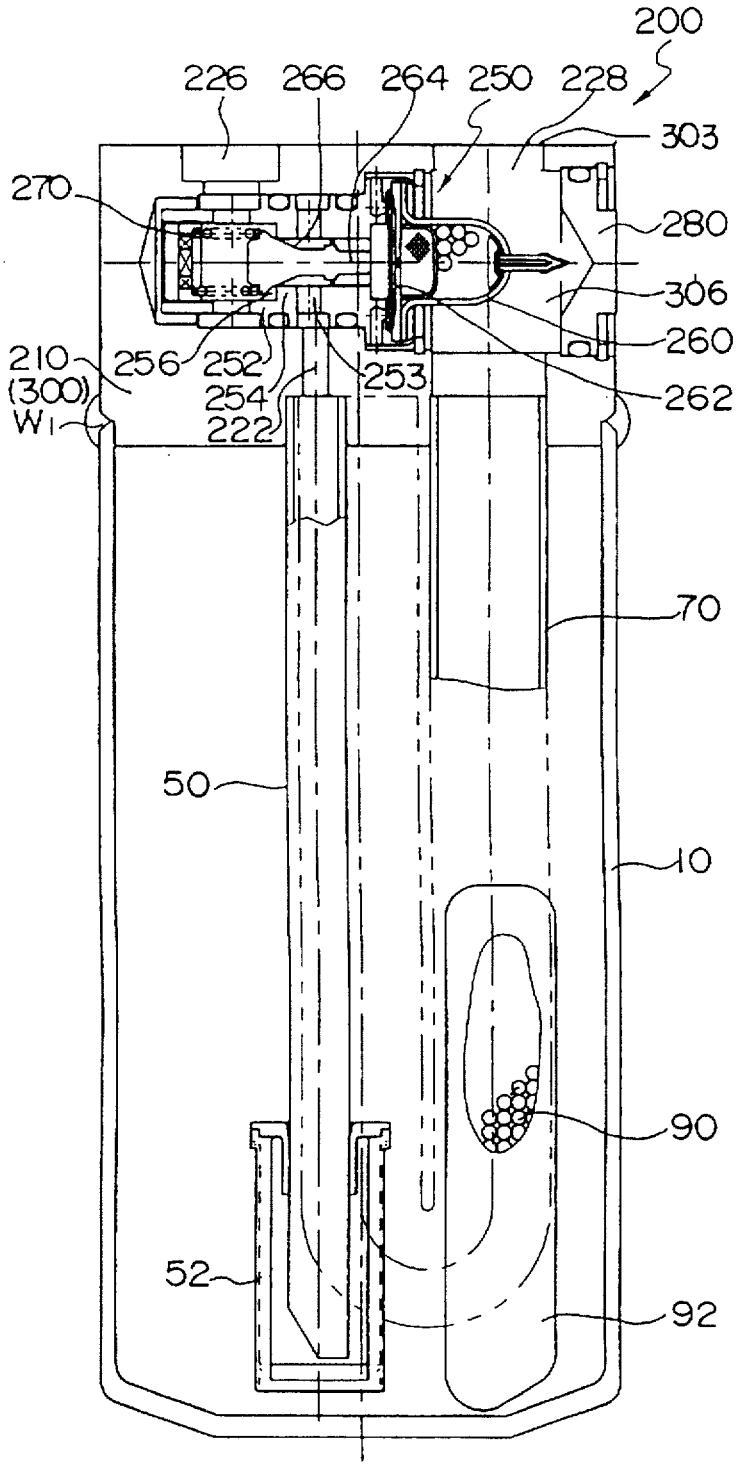
FIG. 11 is a cross-sectional of another embodiment of the invention.

FIG. 11 is a top view of another embodiment of the invention.

Figure 13:
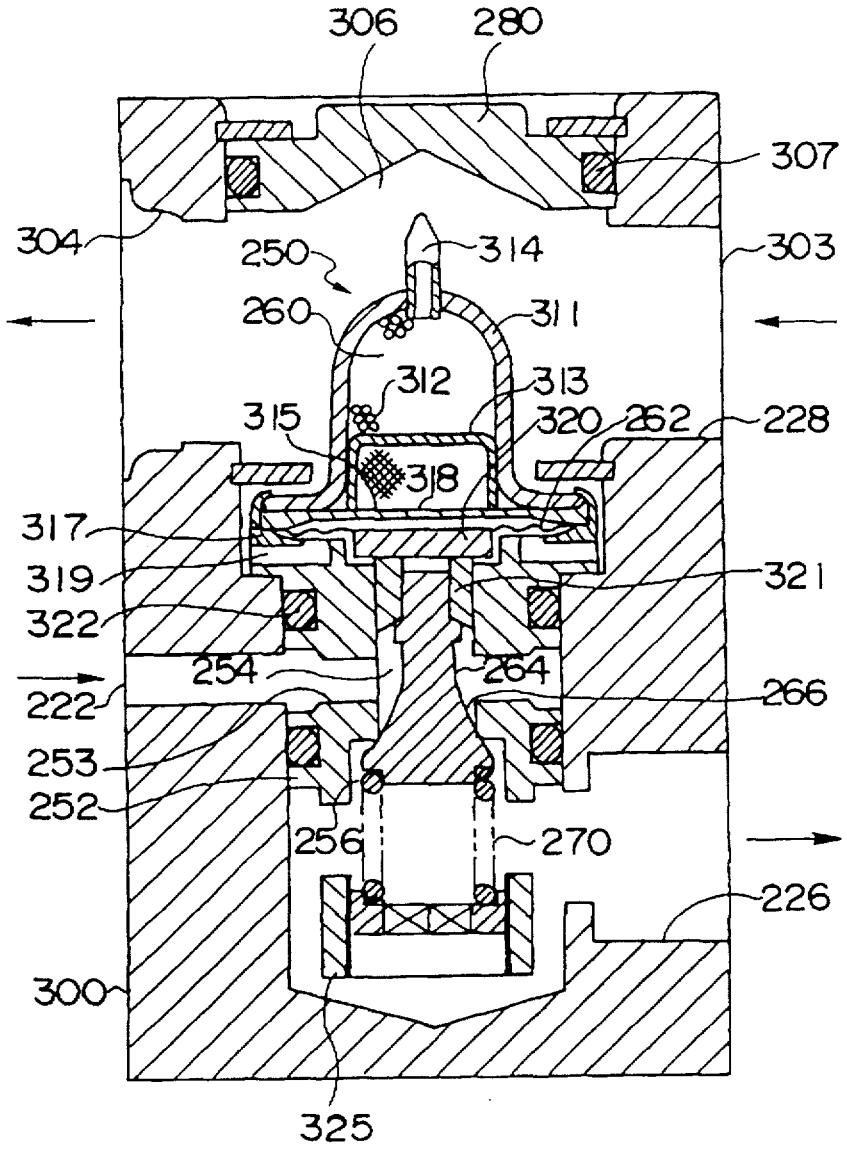
FIG. 13 is a diagram illustrating a conventional block-type expansion valve.

In this embodiment, a box-shaped expansion valve is attached to the reservoir tank. Box-shaped expansion valves are known from Japanese Patent Publication No. 5-71860, for example, as shown in FIG. 13. Namely, a block housing 300 has an inlet port 222 for introducing a liquid refrigerant from a condenser (not shown), an outlet port for delivering the refrigerant to an evaporator (not shown), and an inlet port 303 of a pathway 228 for introducing the refrigerant changed into the gaseous phase by heat exchange while passing thorough the evaporator, and an outlet port 304 for delivering the gaseous refrigerant to the compressor. Arrows in FIG. 13 indicate traveling directions of the refrigerant.

The block casing 300 is made of an aluminum alloy, for example. A plug 280 and an O-ring 307 seal a blind bore 306 formed in the block casing 300 to accommodate a valve unit 250. The valve unit 250 comprises a power element portion 260 corresponding to the valve driving mechanism of the expansion valve 100 in the foregoing embodiments, a valve member 264 having a tapered portion 260, and a biasing spring 270. The power element portion 260 comprises a heat sensitive chamber enclosed by a power element casing 311 and a bottom plate 315 and containing active carbon. Introduced into the heat sensitive chamber is a heat sensitive gas through a tube 314 sealed later. The heat sensitive gas may be the same refrigerant or another refrigerant having the same nature as the refrigerant used in the refrigerant cycle. The bottom plate 315 has a gas conduit 318 in its central portion to increase or decrease the amount of the active carbon and to locate the active carbon in the refrigerant pathway. A mesh 313 is provided to prevent the active carbon from stuffing a vapor conduit 318. A diaphragm 262 is disposed between the bottom plate 315 and a diaphragm support 317, and outer circumferential edges of the diaphragm 262, power element casing 311 and diaphragm support 317 are joined by caulking the diaphragm support 317, and airtightly sealed by a solder.

The diaphragm 262 is made of a stainless steel, for example. The diaphragm 262 is corrugated along its outer circumferential portion such that it can deflect upon any change in pressure in the interior space of the power element casing 311 above the diaphragm 262. The deflection $\delta$ of the diaphragm 262 is determined by the differential pressure $\Delta P$ between the pressure $P_B$ in the interior space of the power element casing 311 above the diaphragm 262 and the pressure $P_L$ applied to the lower surface of the diaphragm 262 exposed to an equalizing bore 319 ($P_L$ being the pressure of the refrigerant traveling from the inlet port 303 of the gaseous refrigerant pathway 228 toward the outlet port 304), and the force F1 pressing the valve member 264 downward is determined by $\delta$ and $\Delta P$.

The bottom plate 315 limits the upward deformation of the diaphragm 262. A stopper 320 is provided to limit the downward deformation of the diaphragm 262. The force F1 pressing the valve member 264 downward is transmitted to the valve member 264 via the stopper 320 and a collar 321.

The collar 321 is used to fix a bellows-type seal 322 to the valve member 264. The bellows-type seal 322 keeps an equalizing chamber under the diaphragm unaffected from the high-pressure liquid refrigerant introduced from the liquid refrigerant inlet 222. The collar 321, bellows-type seal 322 and valve member 264 are incorporated into a integral form and slidably mounted in a central interior space of the body 252. The body 252 includes a high-pressure liquid inlet communicating with the liquid refrigerant inlet 222 and extending across the central interior space. The body 252 also defines a lower interior space 256 with a larger diameter than that of the central interior space, and the lower end of the central interior space is used as a valve port 254. A biasing coil spring 270 is held in the lower interior space, and the biasing force of the spring 270 is adjusted by an adjusting screw 325.

The chamber of the power element portion 260 containing the active coal 312 senses the temperature of the refrigerant flowing from the gaseous refrigerant inlet 303 through the power element case 311 to the gaseous refrigerant outlet 304. This temperature corresponds to the superheated steam temperature of the refrigerant, and the pressure corresponding to the temperature becomes the pressure $P_B$ in the interior space of the power element casing 311 above the diaphragm 262 due to the absorption equilibrium. On the other hand, F1 related to $P_B-P_L=\Delta P$ and the deflection $\delta$ of the diaphragm 262 becomes the force urging the valve member 264. Thus, its biasing force and the configuration of the valve member 264 determine the fluid power and then the opening rate of the valve.

In this manner, the flow rate of the refrigerant running from the liquid refrigerant inlet port 222 toward the refrigerant outlet port 226 is controlled. An expansion valve of such a box-type is incorporated into the reservoir tank 10 as shown in FIG. 11 where the same and equivalent parts or elements are labelled with the same reference numerals. In FIG. 11, a housing 210 constituting the block 300 of the box-type expansion valve 200 is fixed onto the top end of the reservoir tank 10 by arc welding at W1. The housing 210 has an inlet port (not shown) in form of a through hole for introducing the refrigerant from a condenser (not shown) and a port (not shown) in form of a through hole for delivering the refrigerant to a compressor (not shown).

In the housing 210, a blind hole extending from the upper surface is used as the outlet for supplying the refrigerant to an evaporator, and a blind hole extending from the bottom surface is used as the inlet for introducing a liquid refrigerant. The housing 210 also has a through hole 228 used as the low-pressure refrigerant pathway, and its inlet is shown at 303.

Center lines of the inlet 222, outlet 226 and through hole 228 lie on a common plane, and are communicated with each other by a blind hole 306 extending in the horizontal direction. The blind hole 306 contains a valve unit 250, and its aperture is sealed by a plug 280.

The valve unit 250 includes a cylindrical body 252 defining in its center a valve port 254 for containing the valve member 264. The valve body 252 also defines a bore 253 communicating with the valve port 254 and with the pipe 50 of the reservoir tank 10 via the inlet 222. The pipe 50 is connected to the inlet 222 by brazing.

The valve member 264 is driven by the diaphragm 262 in the power element portion 260 exposed to the through hole 228. The valve member 264 has a tapered portion 266, and is biased by a spring 270 toward the diaphragm 262. When the valve port 254 communicates with the lower interior space 256 by a downward movement of the valve member 264, the refrigerant is drawn from the reservoir tank 10 through the strainer 52, the pipe 50 and the valve port 254 into the lower interior space 256, and is decompressed when entering from the valve port 254 to the lower interior space 256. The low-pressure refrigerant then flows through the outlet 226 to the evaporator.

After the refrigerant is vaporized in the evaporator, it enters into the inlet port 303 of the expansion valve 200, and transmits thermal information of the refrigerant to the power element portion 260.

When the gaseous refrigerant runs through the pipe 70, it exchanges heat with and cools the liquid refrigerant contained in the reservoir tank 10. After that, the refrigerant is sent toward the compressor via a port (not shown).

Thus, the liquid refrigerant is supercooled by the heat exchange and remains sufficiently cool when it is introduced from the reservoir tank 10 through the pipe 50 and reaches the inlet port 222 of the expansion valve 200. Therefore, a sufficient flow rate of the refrigerant through the expansion valve 200 can be ensured without being vaporized before reaching the expansion valve 200.

As explained above, by incorporating a reservoir tank for storing a refrigerant and an expansion valve for expanding the refrigerant into a built-in unit, a compact air conditioning system can be obtained. At the same time, since the refrigerant exiting from an evaporator is introduced into the reservoir tank before entering a compressor to exchange heat with the liquid refrigerant stored in the reservoir tank, the refrigerant in the reservoir tank remains sufficiently cool and maintains the liquid phase when it is introduced into the expansion valve. Therefore, a decrease in refrigerating power caused by a decrease in flow rate of the refrigerant can be prevented.

Moreover, by using a cover of the reservoir tank commonly as a housing of the expansion valve, these both structures can be joined together by a single welding process, which also contributes to a reduction in number of parts and elements of the system.

The reservoir tank used in the invention may be either circular-cylindrical or box-shaped.

What is claimed is:

1. A single structure unit for a refrigerating cycle including a compressor and an evaporator, said unit comprising:

an expansion valve; and a reservoir tank having a refrigerant supply pathway in which a gaseous refrigerant introduced from said expansion valve flows toward the compressor in said refrigerating cycle while exchanging heat with a liquid refrigerant stored in said reservoir tank, wherein said expansion valve is united with said reservoir tank.

2. The unit according to claim 1, wherein said expansion valve includes a heat sensor in a second pathway, said second pathway introducing the refrigerant from the evaporator to said reservoir tank.

3. The unit according to claim 1, further comprising a housing fixed to an opening of said reservoir tank, and said expansion valve integrally contained in said housing.

4. The unit according to claim 1, further comprising a cover secured to an opening of said reservoir tank, and said expansion valve having a housing fixed to said cover.

5. The unit according to claim 1, wherein said reservoir tank has an approximately circular-cylindrical outer configuration.

6. The unit according to claim 1, wherein said reservoir tank has an approximately box-shaped outer configuration.

7. The unit according to claim 1, wherein a heat sensor is located in said expansion valve.

8. A single structure for handling a liquid refrigerant, comprising:

a reservoir tank for storing the liquid refrigerant; and an expansion valve united with said reservoir tank for decompressing the liquid refrigerant into a gaseous refrigerant;

wherein the liquid refrigerant stored in said reservoir is supercooled by the gaseous refrigerant.

9. A refrigerating cycle unit, comprising:

a compressor for compressing a gaseous refrigerant;

a condenser for liquefying the gaseous refrigerant compressed by said compressor into a liquid refrigerant;

a reservoir tank for storing the liquid refrigerant;

an expansion valve for changing the liquid refrigerant from said reservoir tank into the gaseous refrigerant;

an evaporator for effecting heat exchange between air and the gaseous refrigerant from the expansion valve; and a pipe for supplying the gaseous refrigerant from said expansion valve to said compressor, said pipe extending inside said reservoir tank for exchanging heat with the liquid refrigerant stored in said reservoir tank;

wherein said reservoir tank and said expansion valve are united into a single structure.

* * * * *